United States Patent [19]

Hake et al.

[11] Patent Number: 4,478,298

[45] Date of Patent: Oct. 23, 1984

[54] DRILL BIT STUD AND METHOD OF MANUFACTURE

[75] Inventors: Lewis W. Hake; Charles F. Huff; J. Wayne Miller, all of Midland, Tex.

[73] Assignee: Petroleum Concepts, Inc., Midland, Tex.

[21] Appl. No.: 449,137

[22] Filed: Dec. 13, 1982

[51] Int. Cl.[3] ..... E21B 10/46

[52] U.S. Cl. ..... 175/329; 175/410

[58] Field of Search ..... 175/329, 409, 410, 374; 29/525; 76/108 B, DIG. 12; 125/39; 408/145; 407/118, 119; 51/307, 309, 293

[56] References Cited

U.S. PATENT DOCUMENTS

| | | | |
|---|---|---|---|
| 4,156,329 | 5/1979 | Daniels | 51/295 |
| 4,373,410 | 2/1983 | Davis | 51/309 X |
| 4,397,361 | 8/1983 | Langford, Jr. | 175/329 |

OTHER PUBLICATIONS

"Drilling Application Successes" Brian C. Atkins, 1982, p. 4 FIG. 5.

*Primary Examiner*—Stephen J. Novosad
*Assistant Examiner*—Michael Starinsky
*Attorney, Agent, or Firm*—Wendell Coffee

[57] ABSTRACT

A polycrystalline diamond compact is a polycrystalline diamond wafer attached to a tungsten carbide substrate forming a disc. In this form, it is attached to a stud which is attached within a drill bit. The compact is attached to the stud with the aid of a positioning ring. When the stud is made of impact resistant material, a full pedestal may be formed on the stud to facilitate the use of the positioning ring. When the stud is made of brittle material, the positioning ring is attached to the flat face of the stud without a pedestal. The ring is positioned on a stud and the disc inserted in the ring so that the disc is positioned against the bonding surface. The disc remains in position against the bonding surface during the handling before and during the bonding process. As a second embodiment, the polycrystalline diamond compact is smaller than the disc itself and the remainder of the disc is formed of metal having the same thickness as the polycrystalline diamond compact or its tungsten carbide substrate. The shape of the smaller polycrystalline diamond compact may be semi-circular, circular, polygon shaped, (i.e., triangular, square, etc.) or other geometric figures.

9 Claims, 11 Drawing Figures

DRILL BIT STUD AND METHOD OF MANUFACTURE

BACKGROUND OF THE INVENTION (1) Field of the Invention

This invention relates to cutting discs and particularly to earth boring and more particularly to a polycrystalline diamond compact mounted on a stud, which is inserted into a drilling bit.

(2) Description of the Prior Art

Before this application was filed, a search was made in the United States Patent and Trademark Office.

| | |
|---|---|
| ROWLEY ET AL | 4,073,354 |
| ROWLEY ET AL | 4,244,432 |
| MORRIS ET AL | 4,265,324 |
| DENNIS | 4,323,130 |
| RADTKE | 4,350,215 |

Dennis is particularly referred to because of his tabulation or listing of prior art references of polycrystalline diamond compact discs mounted on studs in a drill bit.

Radtke teaches that the size of the cutters should be related to the particular formation being drilled when using polycrystalline diamond compact studs.

The remaining references do not appear to be as pertinent as Dennis and Radtke. However, they are considered relevant because it is believed that they would be considered of interest by the Examiner inasmuch at they were reported by an experienced patent searcher.

SUMMARY OF THE INVENTION

New Functions and Surprising Results

We have invented a device and method of manufacture for placing the compact upon the stud. First a pedestal, or flat area, is formed on the stud with a cylindrical base. Then a ring is fitted around the pedestal or attached to the flat stud and the polycrystalline diamond compact disc placed within the ring. This achieves unusual and surprising results, specifically:

(1) It is easy to assemble.

(2) There is a uniform quality of the attachment bond.

(3) There is a positive positioning of the cutter disc upon the stud.

(4) The precision positioning reduces stress risers in the bond area to a minimum.

(5) The precision positioning reduces stress risers within the stud and within the cutter.

(6) Different, simple techniques may be used for attaching various shapes and sizes of cutters within the disc.

(7) The pedestal may be finished (i.e., by machining, grinding, or polishing) so that superior bonding of the disc to the stud is achieved.

(8) The interface between the disc and stud is protected during the attachment process.

(9) The positioning ring remains on the stud during field use and there is no requirement that it be removed.

(10) The ring, remaining on the stud, adds strength to the attachment.

(11) The ring provides protection for the disc when the bit is being lowered into the well bore.

(12) The shape of the stud may be of any particular shape and the shape of the stud (except for the pedestal), need not be specially designed for a positioning fixture.

(13) The technique may be adapted to any type stud geometry fabricated of a wide variety of materials.

Those skilled in the art will understand the tremendous stress placed upon these cutters in cutting the formations. Should the disc not be exactly centered upon its supporting base, there will be stress risers within the bond between the cutter and the base.

The positioning of the cutter is complicated when the polycrystalline diamond compact is diffusion bonded to the stud. In diffusion bonding, the parts are held together under tremendously high pressures for an extended period of time at elevated temperatures. Without the use of this invention, such bonding is extremely difficult.

Thus it may be seen that the total functions and results achieved by our combination far exceeds the sum of the functions of the individual elements, such as pedestals, rings, polycrystalline diamond compacts, etc.

OBJECTS OF THIS INVENTION

An object of this invention is to provide a polycrystalline diamond compact faced stud.

Another object is to provide such a stud for use in a drill bit to drill in hard formations in the earth.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

Other objects are to achieve the above with a method that is versatile, ecologically compatible, energy conserving, rapid, efficient, and inexpensive, and does not require highly skilled people to install, operate, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
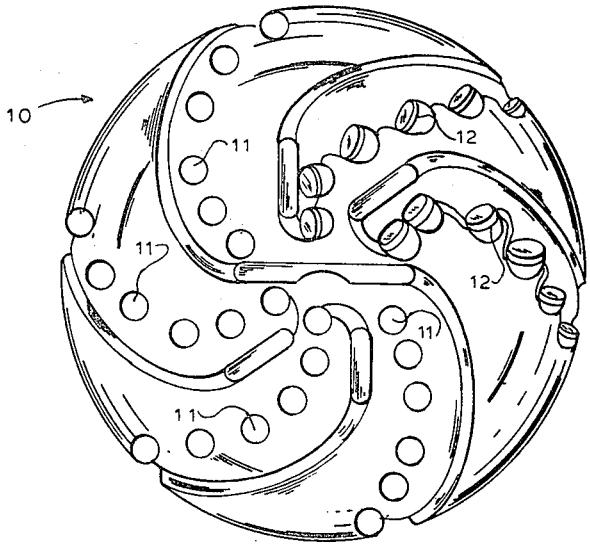
FIG. 1 is a plan view of a typical drill bit with some studs installed according to this invention therein.
Figure 2:
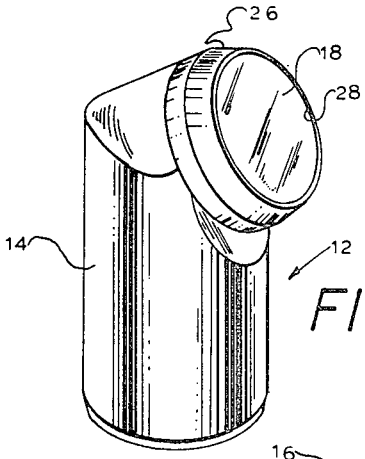
FIG. 2 is a perspective view of a stud according to this invention.

Referring to the drawings, and more particularly FIG. 1, there may be seen a drill bit 10. Not shown on the drill bit is the pin connection whereby the bit may be connected to a string of pipe to be lowered into a well bore for the drilling of a well. Shown, but not identified, are drilling mud vents and courses for the circulation of drilling fluids as well-known to those skilled in the drilling arts.

The bit has a plurality of holes 11 into which studs 12 are placed. Most of the holes are shown empty in FIG. 1.

Each of the studs 12 has a cylindrical body 14 by which the stud is placed in one of the holes 11 in the drill bit 10. The stud 12 also has a face 16 upon which a disc 18 is placed. The angle of the face 16 referenced to the vertical axis of the stud 12 can be varied depending on the rock formation being cut.

The stud 12 may be made of either steel or tungsten carbide or other suitable engineering materials. Steel is the preferred material for the stud, however in certain usages and locations the requirements of the formation are such that it requires the stud to be made of material other than steel.

When steel or similar ductile material is used, a pedestal 20 is formed around the face 16. The pedestal will be a raised cylindrical portion projecting away from the material of the stud 12. The pedestal 20 will be integral with the stud 12. The pedestal 20 will have a perimeter 22 which is nominally equal to the perimeter 24 of the disc 18. The perimeter 24 of the disc will normally be circular and therefore, the perimeter of the pedestal 22 will also be circular and of the same diameter as the disc 18. Stated otherwise, the disc 18 will be the same size and shape as the pedestal 20, or, they will have coextensive perimeters. When used in this application, "same size and shape" does not include thickness.

Ring 26 is placed over the pedestal 20. The inside, internal opening, or bore 28 of the ring 26 is identical to, or coextensive with, the perimeter of the pedestal 22 which is to say that the bore 28 of the ring 26 has the same size and shape of the pedestal 20, which in normal circumstances will be circular. The ring may be held to the pedestal 20 either by microwelding techniques or by forming a snug or press fit thereto. The height 30 of the ring will be greater than the height of the pedestal 20 so that a band 32 of the ring 26 will extend beyond or above the pedestal 20; i.e. above the face 16. The disc 18 is fitted within the band 32 of the ring 26 and the back 34 of the disc 18 is pressed firmly against the face 16 of the pedestal 20. The back 34 of the disc 18 is flat. When tungsten carbide or other brittle material is used, only the upper part of the stud acts as a pedestal. A portion of the ring is machined away so that the area of full thickness fits over the stud and acts as a positioning device. An alternate method allows the ring to be attached to the flat face of the stud by some metallurgical means such as a microwelding technique.

As noted above, the face 16 of the pedestal 20 is above the material of the stud. Therefore, the surface finishing techniques such as polishing can be performed upon the face 16 of the pedestal 20 to ensure a good bond. This is true whether the diffusion bonding techniques are used or conventional brazing or other techniques are used. Normally, the ring will not touch the formation being drilled. If the metal does touch, it will quickly be abraided away.

Figure 4:
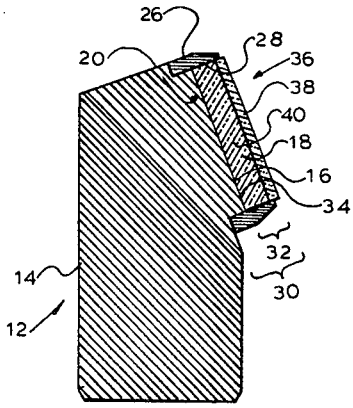
FIG. 4 is an axial sectional view of a stud according to this invention.
Figure 5:
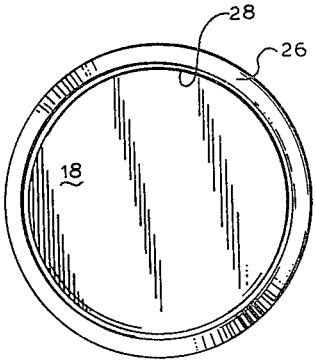
FIG. 5 is an elevational view of the face of the cutter disc.

The disc can be wholly, or partially, composed of a polycrystalline diamond compact. The polycrystalline diamond compact includes a polycrystalline diamond wafer 38 as well as a thicker tungsten carbide substrate 40 which forms the backing for the polycrystalline diamond wafer 38. Thus, the cutter disc 18 shown in FIGS. 4 and 5, for example, is wholly composed of polycrystalline diamond compact 36, having a circular perimeter. The compact 36 is formed by the wafer 38 on the substrate 40. The tungsten carbide substrate 40 forms the entire disc back 34 bonded to the face 16 of the stud. This invention makes possible that the disc be only partially made of the polycrystalline diamond compact. Only about half the disc is ever used as the cutter.

Figure 6:
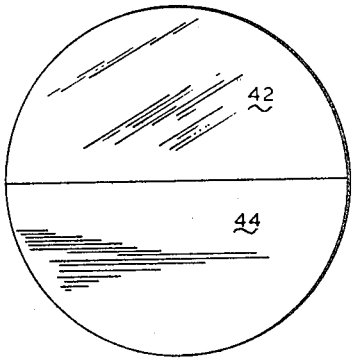
FIGS. 6, 7, and 8 are views similar to FIG. 5 showing other arrangements of polycrystalline diamond compacts upon the stud, FIGS. 6 and 7 without the ring.

Therefore, a semi-circular polycrystalline diamond compact 42 could be used (FIG. 6) as part of the disc 18. The compact 42 is polycrystalline diamond wafer 38 on tungsten carbide substrate 40. The wafer 38 and substrate 40 of the compact 42 have coextensive semi-circular perimeters. The semi-circular compact 42 would be at the distal end of the stud 12. The remainder of the disc or the other semi-circle 44 would be of other material, e.g. steel or other metal. It is not necessary the semi-circles be attached, but merely placed within the ring together and attached to the face 20 of the stud.

Figure 7:
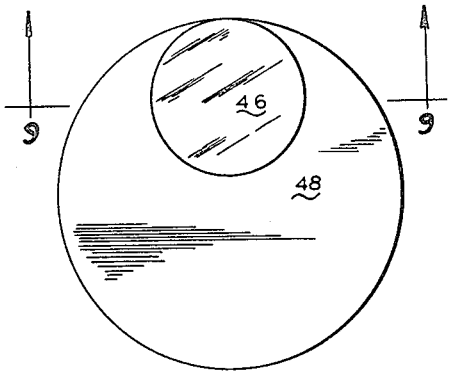
Figure 9:
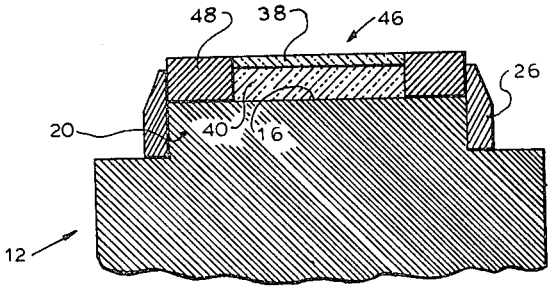
FIG. 9 is a sectional view taken substantially on line 9—9 of FIG. 7.

The prior art teaches that it is desirable that the cutter be smaller for certain types of formation. FIGS. 7 and 9 show a small circle 46 of polycrystalline diamond compact. The circle 46 is placed upon the pedestal 20 with metal slug 48 having a diameter equal to the face of the pedestal 20. The polycrystalline diamond compact circle 46 is in a hole having a diameter equal to the diameter of a circle cut in the metal slug. The compact will be placed within this hole in the desired orientation. FIG. 9 shows the sectional view of the small circle 46 of the polycrystalline diamond compact set within the hole of the metal slug 48. It may be seen that the slug 48 has a thickness or height no less than that of the carbide substrate and can be as high as the polycrystalline diamond compact circle 46, which is composed of polycrystalline diamond wafer 38 set upon the tungsten carbide substrate 40. The slug 48 forms a disc the same as the disc 18 of the first embodiment described, and therefore fits within the ring 26 upon the pedestal 20 of the stud 12.

Figure 8:
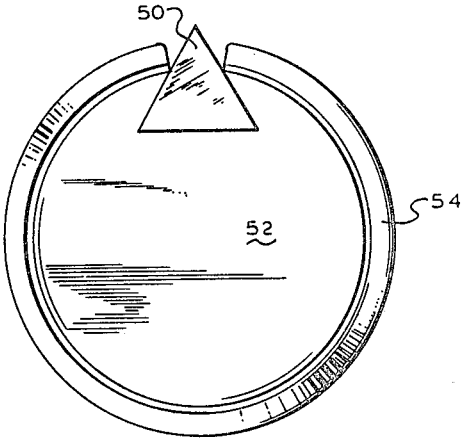

FIG. 8 shows a polycrystalline diamond compact as a triangle 50. This triangle is set within a metal slug 52 which is placed within a ring 54 upon a pedestal (not shown). The triangle 50 is composed of a polycrystalline diamond wafer upon tungsten carbide substrate. The triangle is a polygon figure and it would be set within a hole cut within the slug 52. However, in this case, as seen in the drawing, a portion of the triangle would project beyond the confines of the circle otherwise formed by the disc 52. Also, the ring 54 would not be a fully annular ring, but would cover only about 340° of a full circle. However, those skilled in the art will understand that it would still form the function of positioning and holding the parts together during the bonding process, whether it is by diffusion bonding or some other technique, and also that it would continue to strengthen the attachment of the polycrystalline diamond compact upon the stud after bonding.

Figure 10:
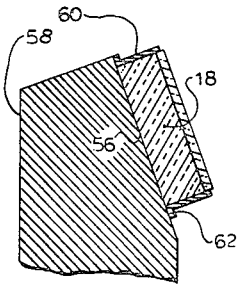
FIG. 10 is a sectional view similar to FIG. 4 showing a flat face and modified form of the ring.
Figure 3:
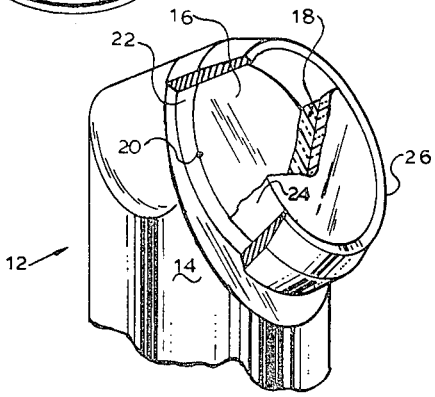
FIG. 3 is a perspective view of a portion of the stud with parts broken away.

FIG. 10 illustrates an embodiment with the disc 18 mounted upon flat face 56 of the stud 58. In this instance, the ring 60 will have a flange 62 which is attached to the stud.

Figure 11:
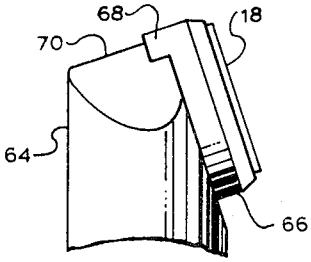
FIG. 11 is an elevational view of another embodiment utilizing a flat face.

FIG. 11 illustrates a stud 64 having a ring 66 around the disc 18. A portion of the ring 66 extends downward from a lip 68. This lip fits over the curved distal end 70 of the stud 64. The radius of curvature of the distal end 70 is the same as the radius of the circular disc 18 and the internal diameter of the ring 66.

The embodiments shown and described above are only exemplary. We do not claim to have invented all the parts, elements or steps described. Various modifications can be made in the construction, material, arrangement, and operation, and still be within the scope of our invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | drill bit | 42 | semi-circular polycrystalline diamond compact |
| 11 | holes | 44 | semi-circle metal |
| 12 | studs | 46 | circle of polycrystalline diamond compact |
| 14 | body of the stud | 48 | metal slug |
| 16 | face | 50 | triangle |
| 18 | disc | 52 | slug |
| 20 | pedestal | 54 | ring |
| 22 | pedestal perimeter | 56 | flat face |
| 24 | disc perimeter | 58 | stud |
| 26 | ring | 60 | ring |
| 28 | bore ring | 62 | flange |
| 30 | height | 64 | stud |
| 32 | band | 66 | ring |
| 34 | back of disc | 68 | lip |
| 36 | polycrystalline diamond compact | 70 | distal end |
| 38 | polycrystalline diamond wafer | | |
| 40 | substrate | | |

We claim as our invention:

1. A drill bit having:

a. a plurality of holes therein b. a plurality of studs, one in each hole, wherein the improvement comprises:

c. an integral pedestal on each stud, d. each pedestal positioned on the bit for proper cutting, e. a cutter disc bonded to each pedestal, f. each disc having a polycrystalline diamond compact formed by a polycrystalline diamond wafer attached to a tungsten carbide substrate, g. the disc and pedestal having a ring encircling them.

2. The invention as defined in claim 1 including all of the limitations a. through g. with the addition of the following limitation:

h. each disc and pedestal being circular.

3. The invention as defined in claim 2 including all of the limitations a. through h. with the addition of the following limitation:

i. the polycrystalline diamond compact and the pedestal having coextensive perimeters.

4. The invention as defined in claim 2 including all of the limitations a. through h. with the addition of the following limitations:

i. the polycrystalline diamond compact perimeter being smaller than the pedestal perimeter, j. a metal slug, k. said polycrystalline diamond compact and slug together forming said disc and l. said disc and the pedestal having coextensive perimeters.

5. A cutting implement comprising:

a. a cutter disc, which is (i) circular, (ii) having a flat back, and including (iii) a polycrystalline diamond compact which is a polycrystalline diamond wafer on a tungsten carbide substrate, b. a stud, c. a flat faced area on the stud, and d. the flat back of the cutter disc which is bonded to the flat faced area, and e. a ring around the cutter disc attached to the flat faced area.

6. The invention as defined in claim 5 including all of the limitations a. through e. with the addition of the following limitation:

f. the disc diffusion bonded to the stud.

7. The invention as defined in claim 6 including all of the limitations a. through f. with the addition of the following limitation:

g. the polycrystalline diamond compact perimeter being smaller than the disc perimeter.

8. The invention as defined in claim 6 including all of the limitations a. through f. with the addition of the following limitation:

g. the polycrystalline diamond compact and the disc having coextensive perimeters.

9. The invention as defined in claim 6 including all of the limitations a. through f. with the addition of the following limitations:

g. a pedestal on the stud, h. said flat faced area on the pedestal.

* * * * *